US008096398B2

(12) United States Patent
Folk et al.

(10) Patent No.: US 8,096,398 B2
(45) Date of Patent: Jan. 17, 2012

(54) EFFICIENT MOVEMENT AND STORAGE OF FUNDS

(75) Inventors: Amy Baker Folk, Charlotte, NC (US); Daniel Christopher Bohen, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 175 days.

(21) Appl. No.: 12/406,181

(22) Filed: Mar. 18, 2009

(65) Prior Publication Data

US 2010/0236996 A1 Sep. 23, 2010

(51) Int. Cl.
*G07F 7/04* (2006.01)

(52) U.S. Cl. ..... 194/206; 209/534

(58) Field of Classification Search ..... 194/206; 340/5.86

See application file for complete search history.

(56) References Cited

U.S. PATENT DOCUMENTS 5,553,320 A 9/1996 Matsuura et al.
5,555,983 A 9/1996 Yamagishi
5,606,157 A 2/1997 Awatsu et al.
6,164,638 A 12/2000 Owens et al.
6,170,818 B1 1/2001 Eastman et al.
6,290,070 B1 9/2001 Graef et al.
6,318,714 B1 11/2001 Beskitt et al.
2002/0088850 A1 7/2002 Katou et al.
2004/0050651 A1 3/2004 Heidel
2004/0249501 A1 * 12/2004 Hand et al. ..... 194/217
2005/0150738 A1 * 7/2005 Hallowell et al. ..... 194/206
2005/0263582 A1 12/2005 Yokoi et al.

OTHER PUBLICATIONS

PCT/US2010/026999, International Search Report and Written Opinion, mailed May 12, 2010.

* cited by examiner

*Primary Examiner* — Mark Beauchaine
(74) *Attorney, Agent, or Firm* — Banner & Witcoff, Ltd.; Michael A. Springs

(57) ABSTRACT

A method of efficiently transferring and storing funds in a cash handling device is presented. In some arrangements, funds will be deposited into the cash handling device and transferred directly to an overflow cassette for storage and transport, rather than being transferred to a traditional storage unit, such as a recycle unit. Prior to transferring the funds, a determination may be made as to the level in the recycle unit. If the level is above a predetermined threshold, the level in the overflow cassette will be evaluated to determine if that level is below a predetermined threshold. If so, the funds will be directly transferred from deposit to the overflow cassette thereby minimizing the processing, movement, etc. of the deposited bills to reduce risk of jams, malfunction, service issues, etc.

21 Claims, 7 Drawing Sheets

EFFICIENT MOVEMENT AND STORAGE OF FUNDS

BACKGROUND

Cash flow refers to the movement of cash over a particular time period within a business or enterprise. The calculation of cash flow may be used as one measure to gauge financial health of the business. Managers in charge of cash flow management may use various tools to assist in making decisions involving cash flow including cash recyclers which allow a retail establishment to maintain and re-use an amount of currency on-site. The cash recycler may further calculate and manage use of cash flows in real-time.

While cash recyclers allow a business to manage their cash flows in a more seamless manner, cash recyclers can be limited by the amount of storage space available in various storage units within the recycler. In some arrangements, an overflow cassette is provided to provide storage for various bills until removal and transport of the bills is completed. Often, bills are processed more than once. For example, an initial transfer may occur to transfer the bills to a recycle unit, and then a second transfer may occur to transfer the bills to from a recycling unit to the overflow cassette, etc. A more efficient process for moving funds within the cash recycler would provide improved efficiency of the unit and may decrease processing time associated with one or more transactions.

SUMMARY

The following presents a simplified summary in order to provide a basic understanding of some aspects of the invention. The summary is not an extensive overview of the invention. It is neither intended to identify key or critical elements of the invention nor to delineate the scope of the invention. The following summary merely presents some concepts of the invention in a simplified form as a prelude to the description below.

Aspects of this disclosure relate to efficiently transferring funds within a cash handling device. In some arrangements, bills may be deposited into a cash handling device. Upon validation of the bills, a denomination of the bills will be determined. A determination may then be made of whether a recycling unit associated with the bills is above a predetermined threshold or target level. If above the threshold, a determination is made as to whether an overflow cassette is above a predetermined threshold. If not, the bills will be transferred directly to the overflow cassette. That is, the bills will be transferred from deposit to the overflow cassette without first being transferred to the recycling cassette. If the overflow cassette is above the predetermined level, the bills will be transferred to an associated recycling unit.

BRIEF DESCRIPTION OF THE DRAWINGS

The present disclosure is illustrated by way of example and not limited in the accompanying figures in which like reference numerals indicate similar elements.

The reader is advised that the attached drawings are not necessarily drawn to scale.

DETAILED DESCRIPTION

Aspects of the present disclosure relate to cash handling devices. Cash handling devices generally refer to devices that are configured to accept and/or dispense currency. Cash handling devices include payment kiosks, point of sale systems such as cash registers, automated teller machines (ATMs), currency recyclers and the like. Currency recyclers generally refer to cash handling devices that are configured to dispense the same currency that was earlier deposited. For example, if a user deposits a 5 dollar bill into a cash recycler machine, the same 5 dollar bill may be dispensed during a subsequent withdrawal transaction. Thus, using currency recyclers, deposited currency may be placed immediately back into use and circulation instead of being held or frozen until a bank is able to collect and reconcile the funds, stored indefinitely and/or taken out of circulation entirely as is the case with other current cash handling devices.

Figure 1:
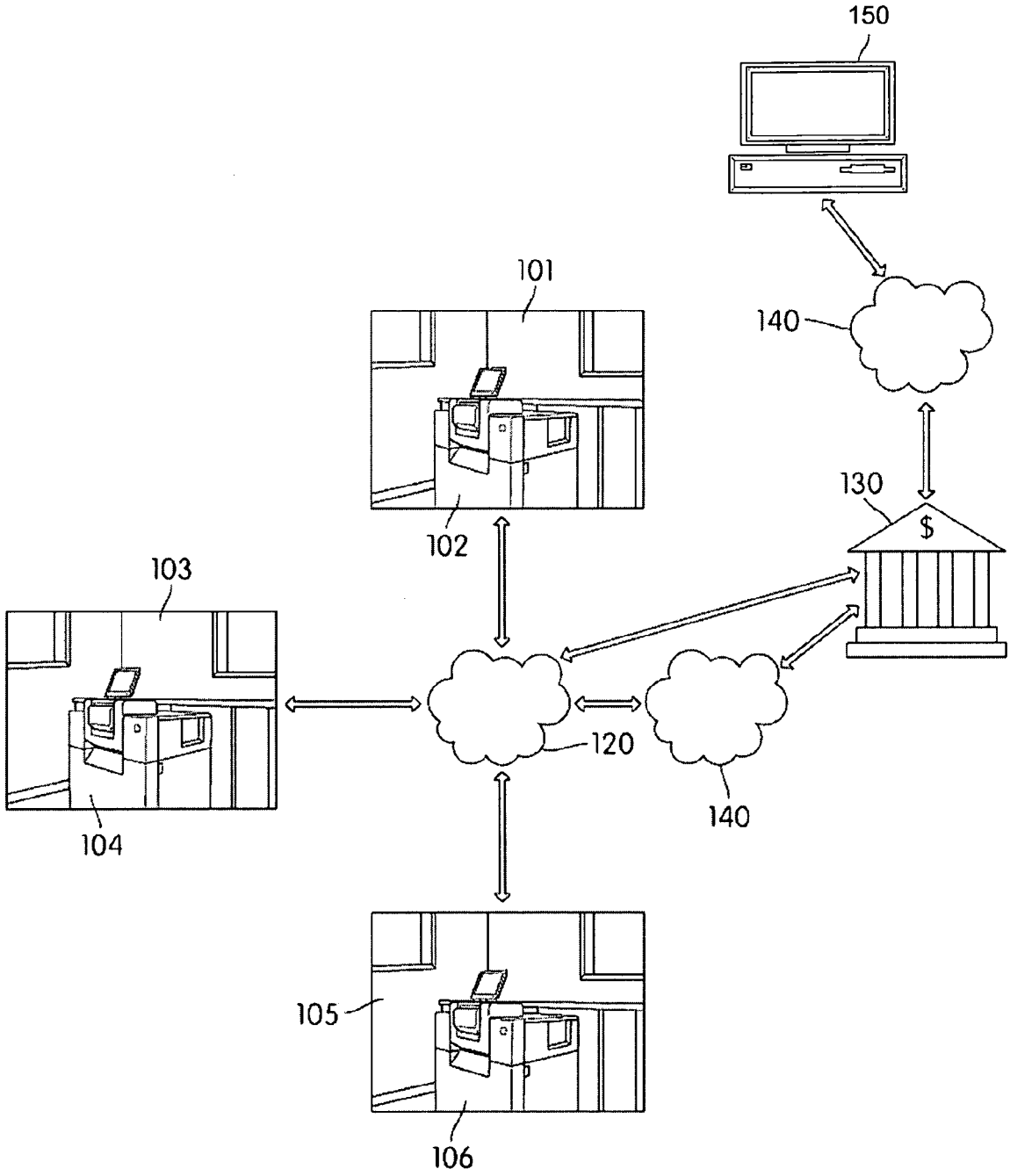
FIG. 1 illustrates an example of a suitable operating environment in which various aspects of the disclosure may be used.

FIG. 1 illustrates an example of a suitable operating environment in which various aspects of the disclosure may be implemented. Devices 102, 104, 106 may include currency recyclers and/or other cash handling devices and may be located at various sites such as locations 101, 103, and 105. The locations may represent different stores of a business enterprise. For example, locations 101, 103, and 105 may represent three different grocery stores located in different geographical areas belonging to a grocery store chain. Those skilled in the art will realize that additional cash handling devices may be located in the same store or in other stores belonging to the grocery store chain. In addition, those skilled in the art will realize that a grocery store chain is only one illustrative example of the types of locations or businesses that cash handling devices such as recyclers may be located. For example, cash recyclers may also be located in gas stations, post offices, department stores, and other places where cash and other financial instruments are deposited or withdrawn.

FIG. 1 further illustrates that cash handling devices 102, 104, and 106 may be connected to a communications network such as communications network 120. Communications network 120 may represent: 1) a local area network (LAN); 2) a simple point-to-point network (such as direct modem-to-modem connection); and/or 3) a wide area network (WAN), including the Internet and other commercial based network services.

Cash handling devices 102, 104, and 106 may communicate with one another or with a financial institution such as bank 130 via communication network 120 in various manners. For example, communications between cash handling devices 102, 104, 106 and bank 130 may use protocols and networks such as TCP/IP, Ethernet, FTP, HTTP, BLUETOOTH, Wi-Fi, ultra wide band (UWB), low power radio frequency (LPRF), radio frequency identification (RFID), infrared communication, IrDA, third-generation (3G) cellular data communications, Global System for Mobile communications (GSM), or other wireless communication networks or the like. Communications network 120 may be directly connected to a financial institution such as bank 130. In another embodiment, communications network 120 may be connected to a second network or series of networks 140 such as the STAR network before being connected to bank 130. According to one or more arrangements, bank 130 may utilize an infrastructure which includes a server 150 having components such as a memory, a processor, a display, and a communication interface.

Figure 2:
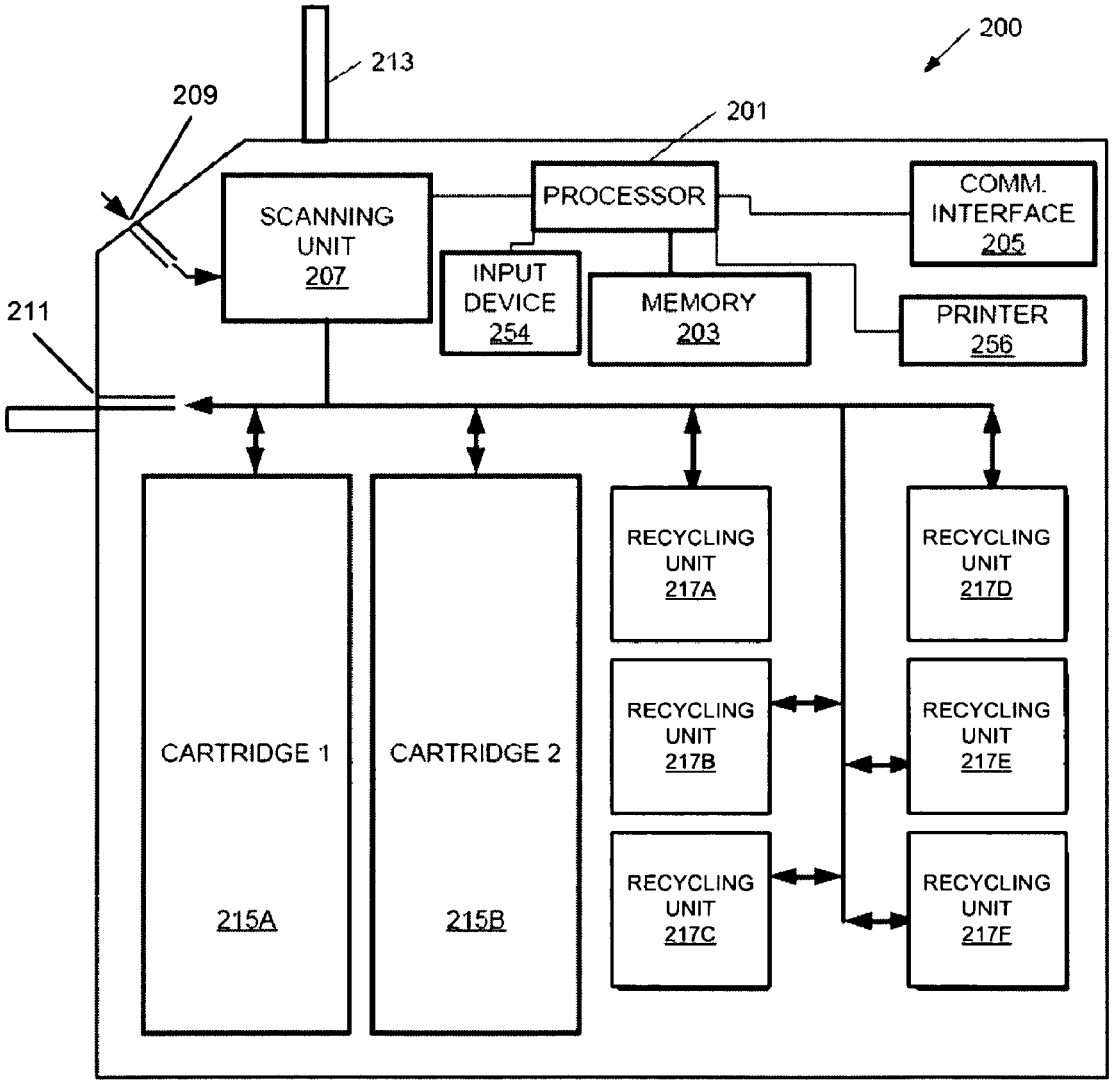
FIG. 2 illustrates a simplified diagram of a currency recycler in accordance with an aspect of the invention.

FIG. 2 illustrates a simplified diagram of a cash recycler that may be used in accordance with the operating environment of FIG. 1. Cash recycler 200 may include processor 201, memory 203, communication interface 205, scanning unit 207, display 213 and various cartridges 215 and recycling units, such as stackers and/or rolled storage modules (RSMs) 217. Processor 201 may be generally configured to execute computer-readable instructions stored in memory 203 such that, for example, cash recycler 200 may send and receive information to and from a bank (e.g., bank 130 of FIG. 1) using communication interface 205 and via a network (e.g., networks 120 and/or 140 of FIG. 1). Memory 203 may be configured to store a variety of information including the aforementioned computer-readable instructions, funds balance data, reconciliation data, user account information and the like. Additionally, memory 203 may include non-volatile and/or volatile memory. One or more databases may be stored in the memories 108, 112, and 116.

Cash recycler 200 may further provide display 213 to present data and/or messages to a user. For example, display 213 may be configured to display a recycler balance, a transaction interface, a current deposit count, security options, transportation options and the like. One or more input devices 254 such as a keypad, keyboard, mouse, touchscreen, fingerprint scanner, retinal scanner, proximity card reader, RFID scanner and/or writer, magnetic card reader, barcode reader, and/or combinations thereof, or any other type of input device or reader capable of inputting, reading, or scanning indicia or information, may also be included in or connected to recycler 200. One or printers 256 may also be included in or connected to recycler 200 for printing receipts and notifications as well.

In cash recycler 200, recycling units 217 and cartridges 215 are configured to store currency. Currency may be inserted through input slot 209 and withdrawn through withdrawal slot 211. Recycling units 217 may be used to store and organize currency based on denomination. For example, all $5 bills may be stored in recycling unit 2 (i.e., recycling unit 217B) while all $20 bills may be stored in recycling unit 3 (i.e., recycling unit 217C). Cartridges 215A and 215B, on the other hand, may be used to store overflow currency and/or currency for transport. Thus, if recycling units 217 become full, additional currency that is deposited into recycler 200 may be stored in an overflow cartridge such as cartridge 215B. One of cartridges 215 may be designated as a transport cartridge that stores currency to be withdrawn from the machine and transported to the bank. Alternatively or additionally, one or more of cartridges 215 may be used as an unfit bill store for currency determined to be defective to a degree that it should be taken out of circulation. Cartridges 215 and recycling units 217 may further be removable for easier access or transport.

Scanning unit 207 may be configured to scan each bill or currency that is inserted into recycler 200. Scanning unit 207 may be configured to detect defects, counterfeits, denomination, type of currency (e.g., which country the currency originates from) and the like. Scanning unit 207 may further be configured to refuse money (either through input slot 209 or withdrawal slot 211) if it cannot be properly recognized or if the currency is deemed to be counterfeit. Scanning unit 207 may send such data to processor 201 which may, in turn, save the data in memory 203.

Further, recycler 200 may include one or more mechanical or electromechanical systems (not shown) for automatically transferring currency between recycling units 217, cartridges 215, input slot 209 and withdrawal slot 211 in recycler 200. For example, currency may automatically be withdrawn from recycling units 217 and directed into cartridge 215A for storage using a series of motorized rollers. In another example, currency stored in cartridge 215A may be withdrawn and organized and stored into recycling units 217 according to denomination. Using such systems to facilitate the automated movement of currency between storage components and other portions of recycler 200 may provide efficiency and security by alleviating some of the need to manually handle currency stored within recycler 200.

Figure 3:
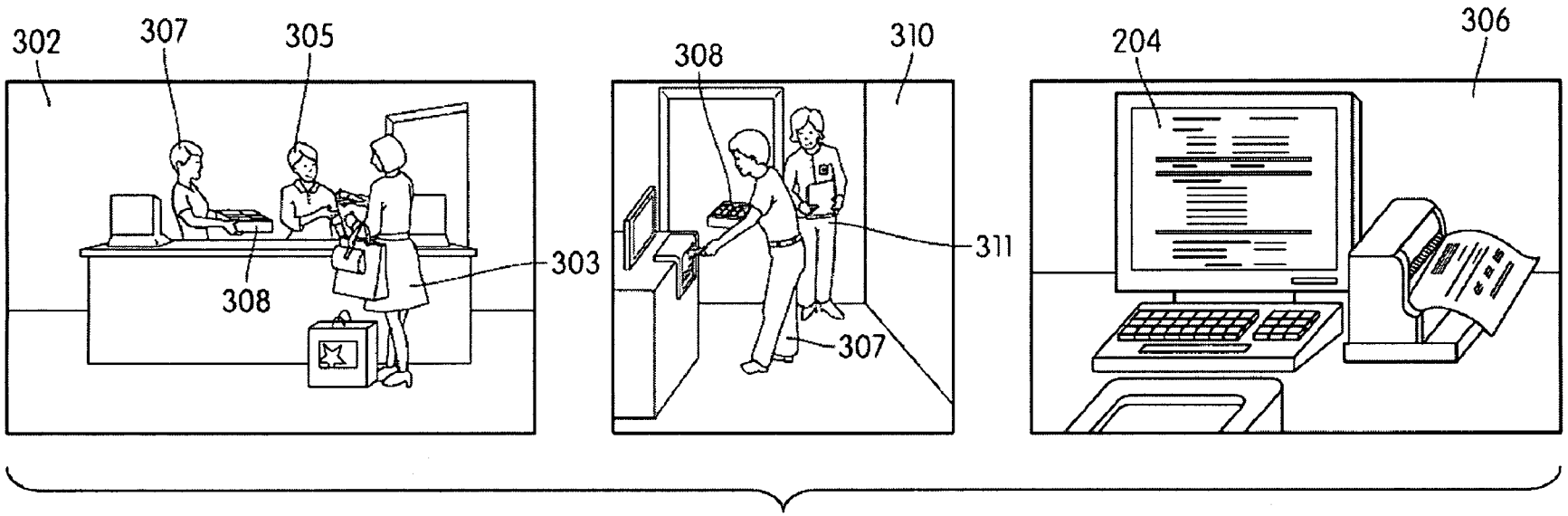
FIG. 3 illustrates various features of a currency recycler that may be used in accordance with aspects of the invention.

FIG. 3 illustrates various features of cash recycler, such as cash recycler 200 of FIG. 2, used in various aspects of the invention. The images in FIG. 3 depict use of a single cash recycler 200 in a retail environment. The retail owner may have a cash recycler 200 located in each of their stores. In an aspect of the invention, summary information for the retail owner's stores may be available via an interface to the financial institution. In another embodiment, access to summary information may be available directly from each of the cash recyclers 200.

In FIG. 3, image 302 depicts customer 303 paying cash to a retail employee such as store cashier 305 for a purchase. Another store cashier 307 at a recently closed cash register may be carrying a cash drawer or till 308 to a back office for reconciliation. In image 310, store cashier 307 may load currency from cash register till 308 into cash recycler 200. In addition, store cashier 307 may also deposit other paper forms of payment received from customer such as checks. An office manager 311 may be supervising cashier 307 during the loading of cash register till 308 into cash recycler 200. Moreover, upon the start of a shift a cashier may fill his/her cash register till with a designated amount of currency dispensed from cash recycler 200.

In image 306 of FIG. 3, a display screen (e.g., display 213 of cash recycler 200 of FIG. 2) may show the total amount entered into cash recycler 200 from till 308. The display screen 213 may breakout the amount entered into cash recycler 200 by denomination and by each cashier. The total amount deposited and withdrawn from cash recycler 200 may be shown on display screen 213.

Figure 4:
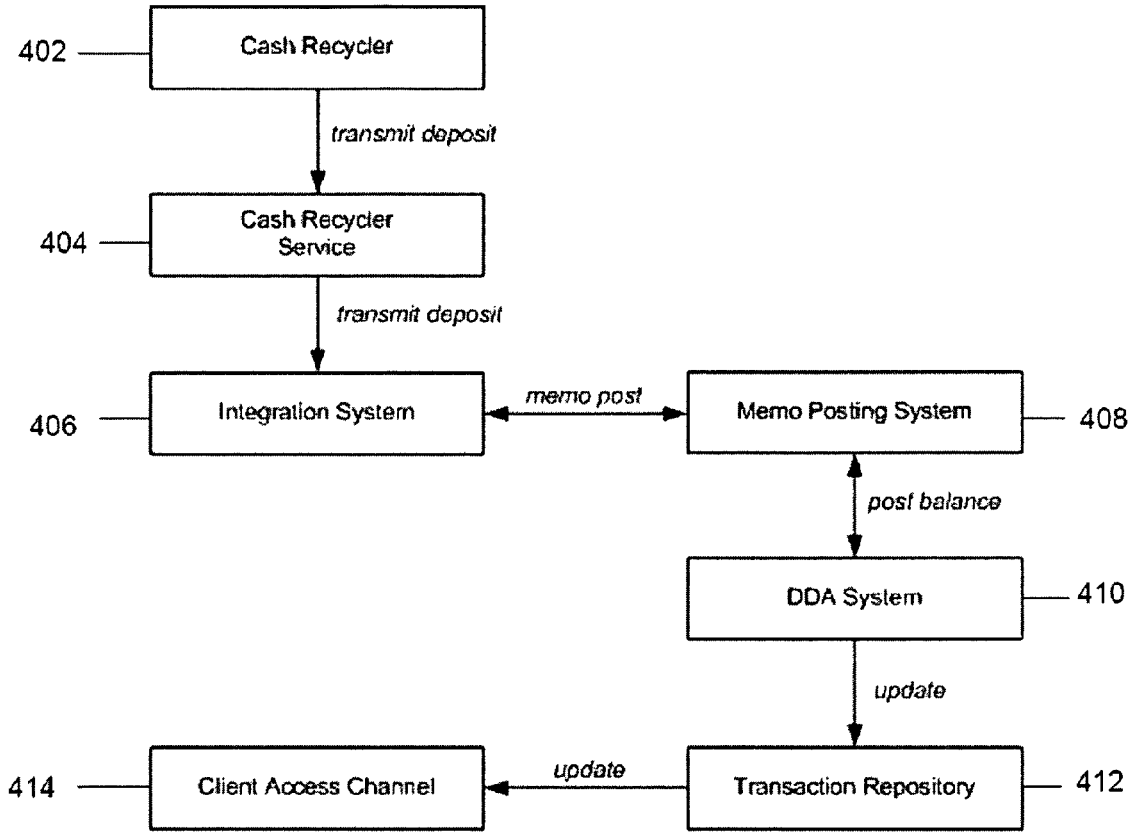
FIG. 4 illustrates additional features of a currency recycler used in various aspects of the invention.

FIG. 4 illustrates a system configuration that may be used in accordance with an aspect of the invention. In FIG. 4 a cash recycler 402 may communicate information to cash recycler service 404 located at a remote location. For example, cash recycler 402 may communicate deposit and withdrawal information from an enterprise location (e.g., a retail store) to the remote cash recycler service 404. The information may be routed through various networks such as the Internet to reach the cash recycler service. The cash recycler service 404 may be located in the data center of a financial institution. The cash recycler service 404 may communicate with an integration system 406 which provides access to the financial systems and processes. The integration system 406 may communicate with a memo posting system 408 which may perform posting activity. The posting system 408 may update the appropriate DDA (direct deposit account) system 410 to reflect the balance changes in the enterprises account balances. The DDA system 410 may also update a transaction repository 412 for historical and intra-day reporting purposes. An enterprise employee may access information stored in the transaction repository 412 through a client access channel 414 via web browser. Those skilled in the art will realize that the financial institution may allow the enterprise user to access the information stored in the transaction repository via numerous alternative communication methods.

According to one aspect, cash recyclers such as cash recycler 102 (FIG. 1) and 200 (FIG. 2) and other cash handling devices may facilitate real-time recognition of funds. In particular, funds deposited at a recycler or other cash handling device at a client site may be recognized by a bank at the time the deposit is made. Recognition refers to the real credit (i.e., not provisional) of deposited funds into a client's account. In contrast to current systems, there is no delay between a deposit of funds and when the funds and transaction data are submitted to the bank for recognition. Thus, instead of having to wait until the end of the day or another prescheduled time for deposits and/or withdrawals to be recognized by the bank, each deposit is processed for recognition in real-time. Data regarding the withdrawal or deposit transaction may be transmitted through a data network to the bank for recognition and processing. Providing real-time recognition offers may advantages including the ability for a client to withdraw the same currency that was earlier deposited for use in the client's operations, all at the client site and without having to first transport the deposited funds to the bank for recognition. Currency recyclers, recycling management and recognition of funds are further described in U.S. application Ser. No. 11/614,656, entitled "Commercial Currency Handling and Servicing Management," filed on Dec. 21, 2006, the content of which is incorporated herein by reference in its entirety.

In some arrangements, cash recyclers may be used to distribute currency to one or more cash drawers or tills, such as a till for a cash register or other point of sale system. The system and method described herein permits a user to preconfigure the amount of currency to be distributed to each till. Further, the preconfigured amount of currency may include the number of bills of each denomination to distribute to each till. In some arrangements, the amount of preconfigured currency is identical for each till to ensure that each point of sale system has the same amount of currency in the till. This aids in balancing funds at the end of a shift, end of a day, etc. In addition, the cash recycler described herein may include one or more slots into which a till may be inserted. Upon insertion of a till, the cash recycler may automatically distribute the preconfigured amount of currency to each till.

Figure 5:
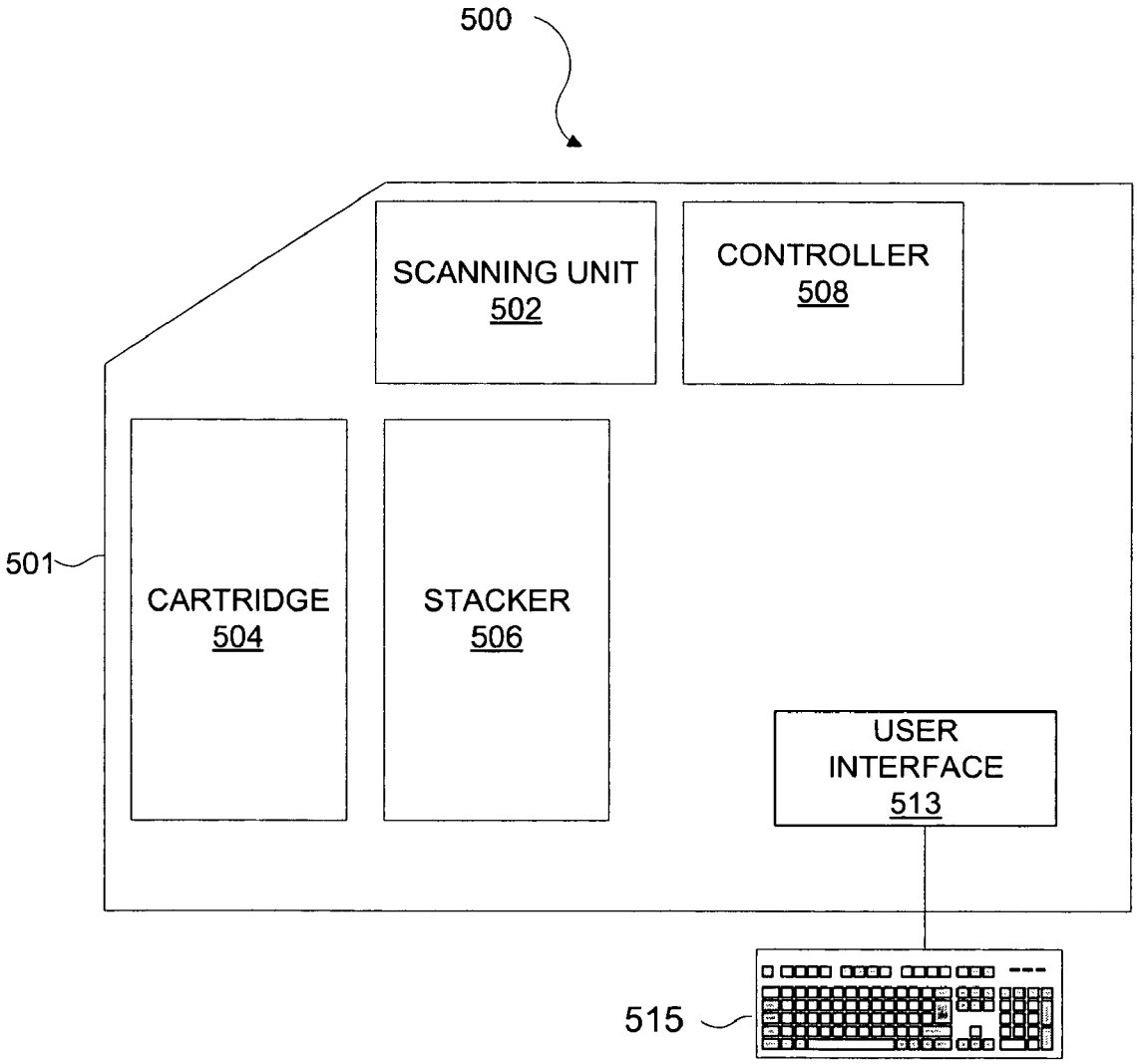
FIG. 5 is a schematic diagram of a currency recycler including various components used in accordance with one or more aspects of the invention.

FIG. 5 illustrates an example cash recycler 500. The cash recycler 500 or other currency handling device described above may include various components. For instance, the cash recycler 500 may include some or all aspects of the cash recycler 200, as shown in FIG. 2. The cash recycler 500 of FIG. 5 includes a controller 508 configured to process transactions including transmitting data to a financial institution for recognition at the financial institution, control mechanical systems of the cash recycler 500, control access to one or more portions of recycler 500, reconcile logical and physical counts of funds and the like. The controller 508 may be an external component or may be integrated into the cash recycler 500. The controller 508 generally includes a processor and memory such as RAM and ROM (not shown). In addition, the controller 508 may include or have access to storage and include user interface 513. The user interface 513 may include a display as well as various input devices such as a keyboard 515, mouse, etc. In some arrangements, the display may be a touch-sensitive display thereby allowing user input to be received through the display. Additionally or alternatively, the user interface 513 may be configured to receive voice commands. The controller 508 may further be configured to control various peripheral devices, such as a printer, external storage device, speakers and the like using one or more adapters and interfaces (not shown).

The controller 508 is further configured to execute software for providing functionality to the cash recycler 500. For instance, the controller 508 may execute commands as directed by the software instructions to control transactions made using the currency recycler 500, communicate with the financial institution or other entity, provide outputs via the user interface 513 or a peripheral device, such as a printer, and also to physically move the currency within the cash recycler 500.

In one example, a user may deposit $1000 into the cash recycler 500. The user provides input through the user interface 513 regarding the deposit. This user input may include selection from a display, voice commands, and the like. The money is then deposited into the cash recycler 500. In one arrangement, the controller 508, in response to various instructions provided by software, may control the mechanical systems of the cash recycler 500, as well as the electronic (e.g., a communications interface) systems of the cash recycler 500. For instance, the controller 508 may operate the mechanical system that controls the flow of currency into the machine during a deposit. In another arrangement, the controller 508 may house the software configured to send and receive transaction data between recycler 500 and a remote device through a communication interface. In addition, the controller 508 controls the scanning device 502 to scan each bill inserted into the cash recycler 500 to confirm authenticity and to verify the condition of the bill. If a bill is deemed to be counterfeit, it may be removed from circulation and stored in a separate region of the cash recycler 500. In particular, the controller 508 may engage various mechanical systems such as automated rollers to store the bill in the separate region. If the bill is deemed too worn to be returned to circulation, the mechanical systems operated by the controller 508 may remove the bill and place it in a separate region for storage. If the bill is deemed suitable to return to circulation it may remain or be placed with the bills in the recycler 500 that are eligible for recirculation from recycler 500. Further, controller 508 may reconcile a deposit amount specified by a depositing user and a physical count of the currency actually deposited to insure accuracy and integrity. In addition, the controller 508 may store data related to the amount of currency inserted into the cash recycler 500, as well as the amount of currency removed from circulation for various reasons. In still other examples, the controller 508 may aid in transmitting the cash transaction information to the financial institution. Additionally or alternatively, the controller 508 may forward a communication, such as an email, to an email box reporting the cash transaction. In still other arrangements, the controller 508 may forward a report of the cash transaction to a peripheral device, such as a printer, to print the report as a record of the cash transaction.

Additionally or alternatively, access to the various functions of the cash recycler 500 may be password protected or may require other authorization, such as use of a radio-frequency identification (RFID) badge and authentication before a user may perform or adjust those functions. In one arrangement, biometric data, such as fingerprint, iris scan, and the like, may be used to authenticate a user of the cash recycler 500 to permit adjustment to various settings. In addition, access to the internal portion of the cash recycler 500 may be restricted to only authorized users. The cash recycler 500 may include one or more locks to prevent unauthorized access to the internal portion of the cash recycler 500. Integrating the controller 508 within the cash recycler 500 provides such additional security to prevent unauthorized access to the computer systems and internal portion of the cash recycler 500 and reduces the ability of would-be intruders to hack into the controller 508 and bypass such security measures.

In some arrangements, bills of one or more denomination may be in such a surplus that transfer of the bills in a recycling unit only to transfer the bills to the overflow cassette for removal would be inefficient. For instance, a store may have a cash recycler on hand. The store may require X number of 20 dollar bills in order to maintain operations. However, the store may take in well over the predetermined X number of bills for operating. In conventional systems, the surplus 20 dollar bills may be transferred to a recycling unit and stored in the unit until transport is scheduled. Once the transport is scheduled or has arrived, the surplus bills may be transferred from the recycling unit to an overflow cassette for removal and transport. In still other arrangements, the recycling unit may have a target level above which surplus bills may be transferred to the overflow cassette. However, the bills are generally first transferred to the recycling unit then transferred from the recycling unit to the overflow cassette. This transfer and/or processing of the bills multiple times increases processing time and can lead to increased risk of jams or other malfunctions and generally provides an inefficient system of processing bills that may be considered surplus.

According to one or more arrangements, surplus bills may be transferred directly to the overflow cassette upon deposit into the cash handling device. In some instances, this may only occur if sufficient storage space for other bills was available within the overflow cassette, as discussed more fully below. In one example, if a recycling unit for a given denomination of bills, e.g., 20 dollar bills, is above a predetermined level, such as a target level, any 20 dollar bills deposited into the cash handling device may be validated and then automatically routed to the overflow cassette for storage until transported to a financial institution for deposit. This efficient movement of surplus bills directly to the overflow cassette reduces or eliminates the need to process bills multiple times and may reduce the risk of jams, malfunctions, etc. because the bill movement is minimized. In addition, the bills might travel on a limited portion of the whole bill path with the cash handling device to be transferred from deposit to the overflow cassette. This transfer through a limited portion of the machine decrease processing time and also reduces risk of jams, malfunctions, service issues, etc.

Figure 6:
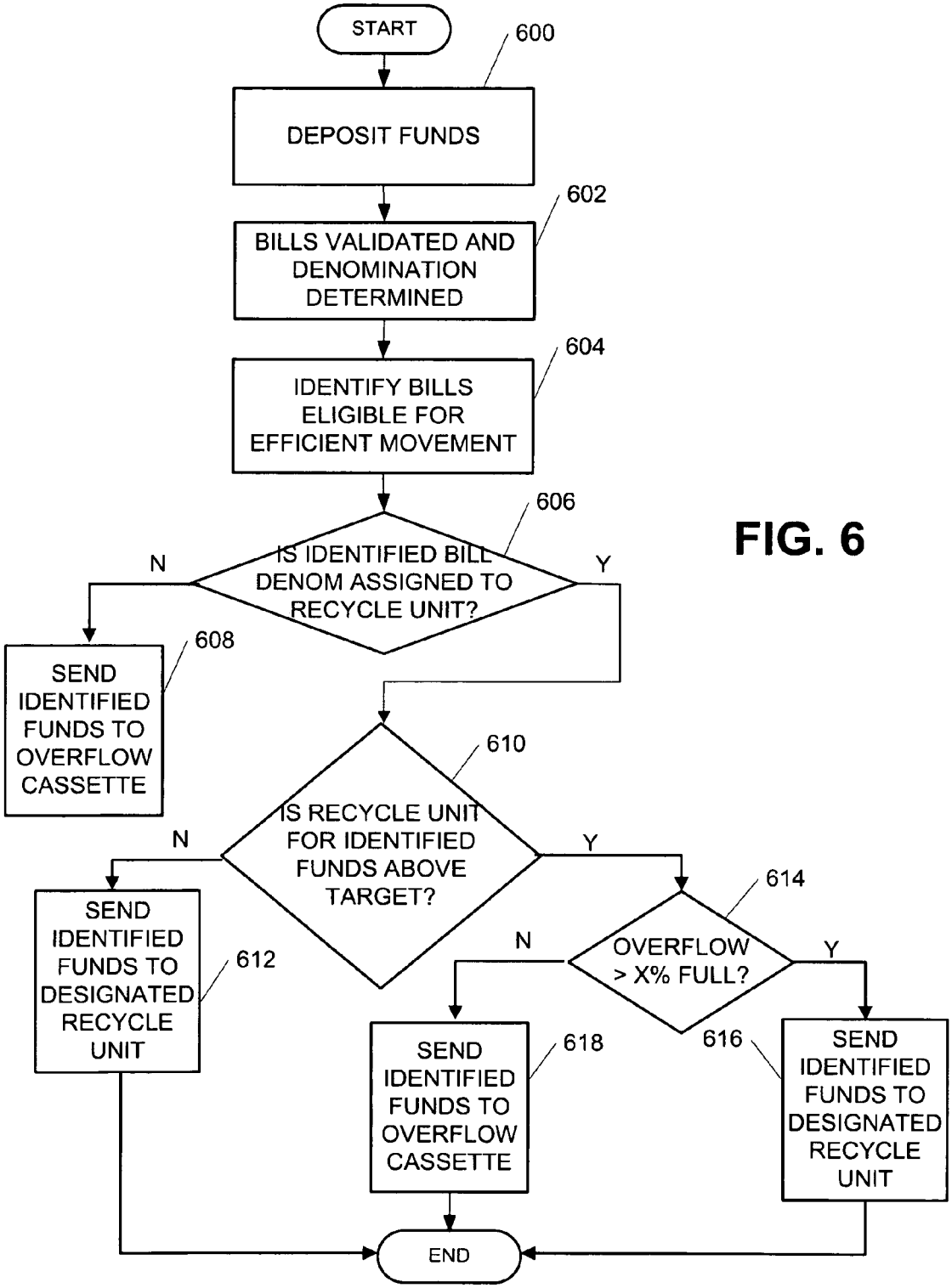
FIG. 6 illustrates one example method of efficiently transferring and storing funds within a cash handling device according to aspects described herein.

In some arrangements, a determination of the level of bills in the overflow cassette may be made prior to eliminating the intermediary step of transferring to the recycle unit and routing directly to the overflow cassette. FIG. 6 illustrates one example method of efficiently transferring funds using this determination. In step 600, a deposit is made to the cash handling device. In step 602 the bills are validated and a determination is made as to the denomination of the deposited bills. In step 604, bills eligible for efficient movement are identified. For instance, a deposit may include ten 5 dollar bills, twenty five 20 dollar bills and one 50 dollar bill. Once the bills are validated, the 20 dollar bills may be identified as eligible for efficient movement because that denomination may have been identified as a denomination often having a surplus of bills. However, multiple denominations of bills may be eligible for efficient movement and the process described herein is not intended to be limited to just one denomination of bills or to just 20 dollar bills.

In step 606, a determination is made as to whether the identified bills are assigned to a recycle unit. If no recycle unit is associated with the bills, the bills are automatically transferred to the overflow cassette in step 608. However, if the bills are associated with a recycle unit, a determination is made in step 610 as to the level of the recycle unit to which the bills are assigned. For instance, a recycle unit may have a target level at which storage of bills, performance, etc. is optimized. The recycle unit may transfer any bills over the target level to a transport storage unit for transport to the financial institution.

If the recycle unit is not above the target level, as determined in step 610, the identified bills will be transferred to the recycle unit in step 612 in order to increase the level of the bills in the unit toward the target level. If the recycle unit is above the target level in step 610, a determination of whether the level of the overflow cassette is above a predetermined threshold will be made in step 614. For instance, an overflow cassette may have a predetermined level at which bills will no longer be transferred directly to the overflow cassette to provide efficient money movement. This permits storage space within the cassette to remain available for transfer of funds that are not assigned to a recycle unit or to allow for fund transfers from other recycle units that may be at a maximum level. In some arrangements, the predetermined level of the overflow cassette may be between 40% and 75%. For instance, in one example a threshold may be set at 60% full. That is, when the overflow cassette reaches 60% full, only bills for which storage space in the designated recycle unit is limited will be transferred to the overflow cassette. Thus, if the overflow cassette is above the threshold in step 614 the identified bills will be sent to the designated recycle unit in step 616. However, if the overflow cassette is below the predetermined level in step 614, the identified bills will be transferred directly to the overflow cassette for storage in step 618.

The determinations made and the transfer of bills to the recycling unit or the overflow cassette may be performed during the transaction or may be performed upon completion of the transaction, for example when a user is finished with a transaction or a group of transactions, etc. Bills deposited into the cash handling device and processed via the above-described method may still be immediately or nearly immediately recognized at the financial institution if the cash handling device is configured for such an arrangement.

Figure 7:
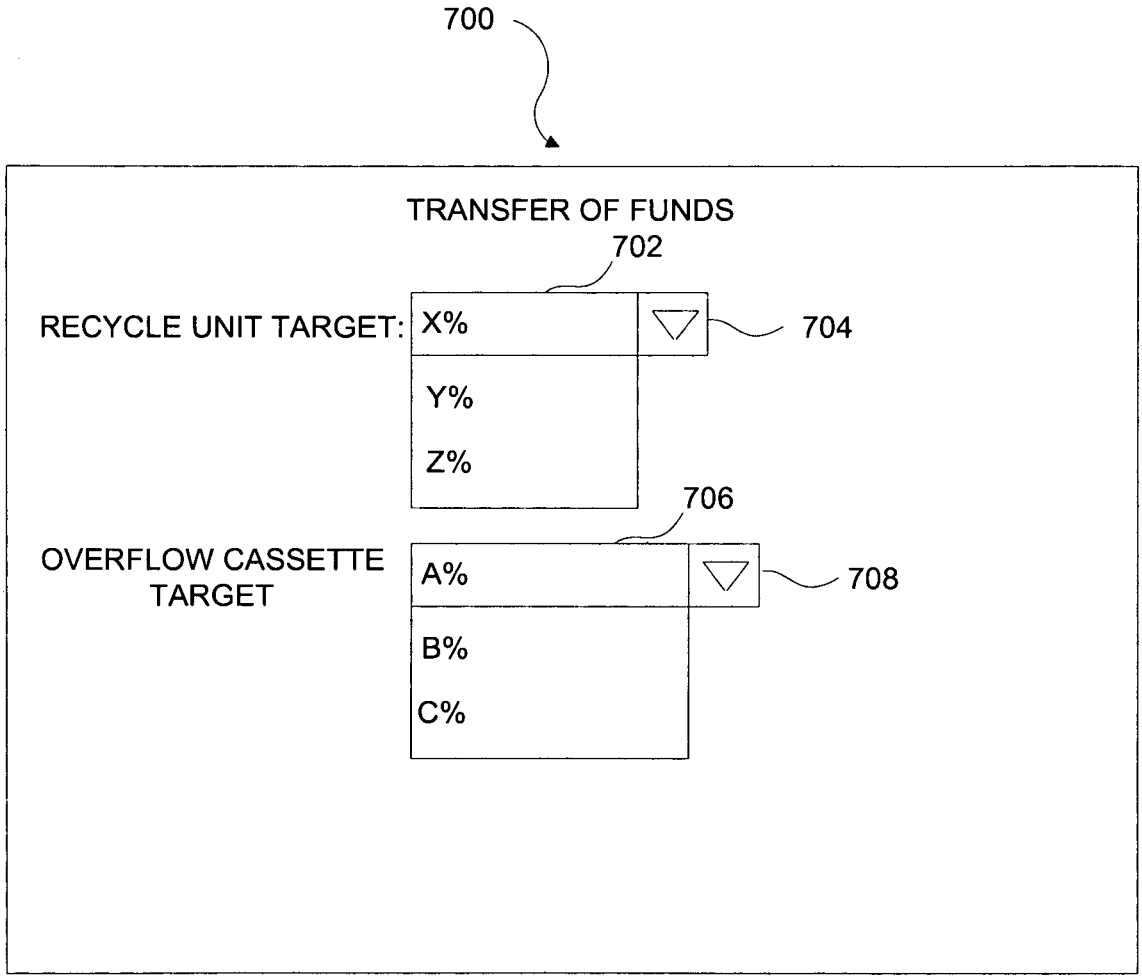
FIG. 7 illustrates one example user interface for configuring the efficient transfer of funds according to aspects described herein.

FIG. 7 illustrates one example user interface for configuring various aspects of the method described herein. For instance, the predetermined threshold levels (for each denomination) of the both the recycle unit and overflow cassette may be determined and input by a user, for instance, at a user interface. In some arrangements, the user interface may be a touch sensitive display and may be positioned on the cash handling device. In other arrangements, the predetermined threshold levels may be determined by a financial institution and may be transmitted to the cash handling device from the financial institution.

The user interface of FIG. 7 includes a field 702 for inputting a predetermined threshold or target level at which the recycling unit contains a level of bills to optimize operation. The target level may adjust based on day of the week, shift, time of day, etc. to account for fluctuations in the amount of cash needed for operation, cash being taken in at the location, etc. Additional details of target levels are discussed in U.S. patent application Ser. No. 12/241,390, filed on Sep. 30, 2008 and entitled "Forecasting Levels of Currency Usage and Need," which is incorporated herein by reference in its entirety. One example field for input of target value is shown. A user may input a desired target value by selecting the value from a drop-down menu activated by button 704. In other arrangements, the user may input the desired value by clicking, double-clicking, etc. on the field and typing in the desired value. In still other arrangements the user may select a radio button associated with a desired value.

In field 706 a user may select the threshold level for the overflow cassette at which funds will not be transferred to the overflow cassette simply for efficient movement of funds. Instead, funds will be transferred to the overflow cassette to reduce levels in one or more recycling units. This will prevent the overflow cassette from becoming filled with bills transferred to it for efficiency which may result in lack of storage for bills not assigned to a recycle unit or bills from other recycle units that may be at a maximum level.

The user may select the desired value by selecting the value from a drop-down menu activated by selection of button 708. Similar to the arrangement discussed above, the desired threshold for the overflow cassette may also be input by selecting the field and typing the value, selection of a radio button, as well as other known methods of selection.

Control of the various mechanical systems used for transferring funds, as well as for systems used to determine where funds should be transferred may be done via a controller, such as controller 508 in FIG. 5. The controller may include or control software and/or hardware to ensure funds are transferred to the desired location.

In some arrangements, the determination of whether to transfer funds to the overflow cassette for efficiency may also include additional factors, such as projected needs, etc. For instance, if a surplus of bills is present in the current shift but the next shift may see an increase in business thereby reducing or eliminating the surplus, funds that may have been sent to the overflow cassette for efficiency may still be transferred to the designated recycle unit based on this projection. The opposite may also be true in which a surplus is anticipated in an upcoming shift so funds may be moved to the overflow cassette in anticipation of the surplus. These needs or projections may be based on, among other factors, the current levels in the one or more recycle units.

In still other arrangements, the efficient movement of funds to the overflow cassette may occur at predetermined times, shifts, days, etc. For instance, certain shifts or days of the week may be known has providing a surplus of one or more denomination so the efficient money movement may be activated during those shifts and not during other shifts.

Although not required, one of ordinary skill in the art will appreciate that various aspects described herein may be embodied as a method, a data processing system, or as one or more computer-readable media storing computer-executable instructions. Accordingly, those aspects may take the form of an entirely hardware embodiment, an entirely software embodiment or an embodiment combining software and hardware aspects. In addition, various signals representing data or events as described herein may be transferred between a source and a destination in the form of light and/or electromagnetic waves traveling through signal-conducting media such as metal wires, optical fibers, and/or wireless transmission media (e.g., air and/or space).

Aspects of the invention have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure.

What is claimed is:

1. A method of transferring funds, comprising:

determining, by a cash handling device, a denomination of funds associated with funds deposited to the cash handling device;

determining whether a level of a recycle unit within the cash handling device associated with the determined denomination of funds is above a predetermined threshold;

responsive to determining that the recycle unit level is above the predetermined threshold, determining whether a level of an overflow cassette is above a predetermined threshold;

responsive to determining that the overflow cassette level is not above the predetermined threshold, transferring the deposited funds to the overflow cassette; and responsive to determining that the overflow cassette level is above the predetermined threshold, transferring the deposited funds to the recycle unit having the determined level above the predetermined threshold.

2. The method of claim 1, further including validating the deposited funds.

3. The method of claim 1, further including responsive to determining that the recycle unit level is not above the predetermined threshold, transferring the deposited funds to the recycle unit.

4. The method of claim 1, further including responsive to determining that the overflow cassette level is at or above the predetermined threshold, transferring the deposited funds to the recycle unit.

5. The method of claim 1, wherein the cash handling device is one of a cash recycler, point of sale system and automated teller machine.

6. The method of claim 1, wherein the step of transferring the deposited funds to the overflow cassette includes transferring funds to the overflow cassette without transferring funds to the recycle unit prior to transferring funds to the overflow cassette.

7. The method of claim 1, further including responsive to determining that the recycle unit level is at or above the predetermined threshold, determining whether an overflow cassette level is above a predetermined threshold; and responsive to determining that the overflow cassette level is not above the predetermined threshold, transferring the deposited funds to the overflow cassette.

8. The method of claim 1, further including:

determining whether a recycle unit is associated with the determined denomination of funds;

responsive to determining that no recycle unit is associated with the determined denomination, transferring the deposited funds to the overflow cassette; and responsive to determining that the recycle unit is associated with the determined denomination, determining whether a level of a recycle unit within the cash handling device associated with the determined denomination of funds is above a predetermined threshold.

9. The method of claim 1, further including determining whether the determined denomination of funds is eligible for the method.

10. One or more non-transitory computer-readable media storing computer readable instructions that, when executed, cause a processor to perform a method, comprising:

determining a denomination associated with funds deposited to a cash handling device;

determining whether a level of a recycle unit of the cash handling device is above a predetermined threshold, the recycle unit being associated with the determined denomination of funds;

responsive to determining that the recycle unit level is above the predetermined threshold, determining whether a level of an overflow cassette is above a predetermined threshold;

responsive to determining that the overflow cassette level is not above the predetermined threshold, transferring the deposited funds to the overflow cassette; and responsive to determining that the overflow cassette level is above the predetermined threshold, transferring the deposited funds to the recycle unit having the determined level above the predetermined threshold.

11. The one or more computer-readable media of claim 10, further including validating the deposited funds.

12. The one or more computer-readable media of claim 10, further including responsive to determining that the recycle unit level is not above the predetermined threshold, transferring the deposited funds to the recycle unit.

13. The one or more computer-readable media of claim 10, further including responsive to determining that the overflow cassette level is at or above the predetermined threshold, transferring the deposited funds to the recycle unit.

14. The one or more computer-readable media of claim 10, wherein the cash handling device is one of a cash recycler, point of sale system and automated teller machine.

15. The one or more computer-readable media of claim 10, wherein the step of transferring the deposited funds to the overflow cassette includes transferring funds to the overflow cassette without transferring funds to the recycle unit prior to transferring funds to the overflow cassette.

16. The one or more computer-readable media of claim 10, further including responsive to determining that the recycle unit level is at or above the predetermined threshold, determining whether an overflow cassette level is above a predetermined threshold; and responsive to determining that the overflow cassette level is not above the predetermined threshold, transferring the deposited funds to the overflow cassette.

17. An apparatus, comprising:

one or more processors; and memory operatively coupled to the one or more processors and storing computer readable instructions that, when executed, cause the apparatus to:

determine a denomination associated with funds deposited to a cash handling device;

determine whether a level of a recycle unit of the cash handling device is above a predetermined threshold, the recycle unit being associated with the determined denomination of funds;

responsive to determining that the recycle unit level is above the predetermined threshold, determine whether a level of an overflow cassette is above a predetermined threshold;

responsive to determining that the overflow cassette level is not above the predetermined threshold, transfer the deposited funds to the overflow cassette; and responsive to determining that the overflow cassette level is above the predetermined threshold, transfer the deposited funds to the recycle unit having the determined level above the predetermined threshold.

18. The apparatus of claim 17, further including responsive to determining that the recycle unit level is not above the predetermined threshold, transfer the deposited funds to the recycle unit.

19. The apparatus of claim 17, further including responsive to determining that the overflow cassette level is at or above the predetermined threshold, transfer the deposited funds to the recycle unit.

20. The apparatus of claim 17, wherein the transfer of the deposited funds to the overflow cassette includes a transfer of funds to the overflow cassette without transferring funds to the recycle unit prior to transferring funds to the overflow cassette.

21. The apparatus of claim 17, further including responsive to determining that the recycle unit level is at or above the predetermined threshold, determine whether an overflow cassette level is above a predetermined threshold; and responsive to determining that the overflow cassette level is not above the predetermined threshold, transfer the deposited funds to the overflow cassette.

* * * * *